United States Patent [19]

Martonffy

[11] 4,225,537

[45] Sep. 30, 1980

[54] CARBONATING DEVICE

[76] Inventor: Stephen Martonffy, 310 E. 55th St., New York, N.Y. 10022

[21] Appl. No.: 692,465

[22] Filed: Jun. 3, 1976

[51] Int. Cl.[3] ..... B01F 3/04

[52] U.S. Cl. ..... 261/70; 261/124; 261/DIG. 7

[58] Field of Search ..... 261/70, 124, DIG. 7, 261/DIG. 65, 142, 21, 92

[56] References Cited

U.S. PATENT DOCUMENTS

| | | | |
|---|---|---|---|
| 829,375 | 8/1906 | Garvey | 261/70 |
| 1,637,516 | 8/1927 | Brilliant | 261/92 |
| 2,066,523 | 1/1937 | Ewart | 261/70 X |
| 2,252,313 | 8/1941 | Bostock | 261/21 X |
| 2,339,640 | 1/1944 | Holinger | 261/DIG. 7 |
| 2,531,655 | 11/1950 | Thompson | 261/70 X |
| 2,549,311 | 4/1951 | Hudson | 261/70 X |
| 2,734,561 | 2/1956 | Funkhouser | 261/70 X |
| 3,178,159 | 4/1965 | Johnson | 261/142 X |
| 3,746,323 | 7/1973 | Buffington | 261/DIG. 7 |
| 3,752,452 | 8/1973 | Iannelli | 261/DIG. 7 |
| 3,864,440 | 2/1975 | Giocoechea | 261/DIG. 65 |

FOREIGN PATENT DOCUMENTS

| | | | |
|---|---|---|---|
| 576213 | 5/1933 | Fed. Rep. of Germany | 261/124 |

*Primary Examiner*—Richard L. Chiesa
*Attorney, Agent, or Firm*—Pennie & Edmonds

[57] ABSTRACT

Disclosed is an apparatus for carbonating water or other beverage comprising a carbonating tank for charging the water with carbon dioxide and for dispensing the carbonated liquid. The apparatus also includes a reservoir tank disposed above the carbonating tank for storing the liquid to be carbonated. The two tanks communicate with each other through a valve which is controlled by a float disposed in the carbonating tank. The float valve is arranged to open and permit the liquid to flow from the reservoir tank into the carbonating tank when the latter is substantially empty and the pressure therein has been reduced by withdrawal of the carbonated liquid sufficiently to allow the liquid to flow into the carbonating tank by gravity.

4 Claims, 2 Drawing Figures

CARBONATING DEVICE

BACKGROUND OF THE INVENTION

This invention relates to a device for carbonating water or other beverages which is especially suited for use in household and commercial refrigerators.

One object of the invention is the carbonation of water, or other beverages, solely by passing carbon dioxide gas through the liquid rather than by the introduction of liquid in comminuted or atomized form into the carbon dioxide gas.

A further object of the invention is to provide for a continuous supply of liquid to be carbonated, such as a household water, without the use of pumps or pumping cycles, and without regard to the water supply pressure.

SUMMARY OF THE INVENTION

In accordance with the invention, the carbonating apparatus comprises a pair of superposed tanks communicating with each other via a conduit provided with a float valve. The lower tank serves as the carbonating vessel and has a gas inlet port with a perforated pipe connected thereto which extends along the bottom of the tank for introducing and mixing the carbon dioxide gas with the liquid to be carbonated. The carbonating tank is also provided with a liquid outlet port for dispensing the carbonated liquid. The upper tank serves as a reservoir for storing a supply of liquid to be carbonated and is connected through a second float valve to a source of such liquid, for example, the household water supply.

The valve in the conduit connecting the two tanks is controlled by a float disposed in the lower or carbonating tank and is thus responsive to the level of the water therein. The valve is arranged to open the conduit and permit water to flow by gravity from the upper tank into the lower tank when the latter is empty or almost empty. The valve connecting the upper tank to the water supply is set to open and permit the water to flow into the upper tank when the water level therein drops below a predetermined level so that the upper tank is maintained substantially full of water during operation.

The two tanks are preferably of a size and shape such that the carbonator can be placed in a compartment of a household or commercial refrigerator. To use the apparatus, the carbonator is placed in the refrigerator, the upper tank is connected to the household water supply and the gas inlet port of the lower tank is connected through an on-off valve to a source of pressurized carbon dioxide, which may be a commercially available gas cylinder. The lower or carbonating tank is then filled with water and charged with carbon dioxide by opening the on-off valve. Once the lower tank is charged, the on-off valve of the gas tank is closed and the apparatus is ready for dispensing carbonated water.

During use, as the carbonated water is dispensed from the apparatus, the water level and the gas pressure in the carbonating tank decrease until the tank is substantially empty. At this point, the float of the valve connecting the two tanks drops to a level such that the valve is opened and the water in the upper tank flows into an fills up the carbonating tank. When the lower tank is full, the valve closes, sealing off the carbonating tank so that it then can be recharged with the carbon dioxide gas. At the same time, the float valve connecting the upper tank with the water source opens and the reservoir tank is refilled with a fresh supply of water.

Since the float valve connecting the two tanks is set to open when the lower tank is substantially empty, the gas pressure in the carbonating tank at that point during the operating cycle is sufficiently low to permit the water to flow from the upper tank into the lower tank under the influence of gravity. This arrangement thus permits the tank containing the pressurized gas to be connected directly to the carbonating apparatus through a simple and inexpensive on-off valve without the need for gas pressure regulating valves to equalize the pressure of the water supply and the gas in the carbonating tank. Furthermore, since by the time the carbonating tank is empty, the water in the reservoir tank has cooled to the ambient temperature of the refrigerator, the carbonated water dispensed from the apparatus is always at the desired cool temperature.

The carbonator of the invention is thus compact, simple in construction and inexpensive to manufacture. Furthermore, since the apparatus does not require any pumps or gas pressure regulating valves, it is simple and efficient in operation, and fundamentally free from service and repair problems.

DETAILED DESCRIPTION OF THE PREFERRED EMBODIMENT

Figure 1:
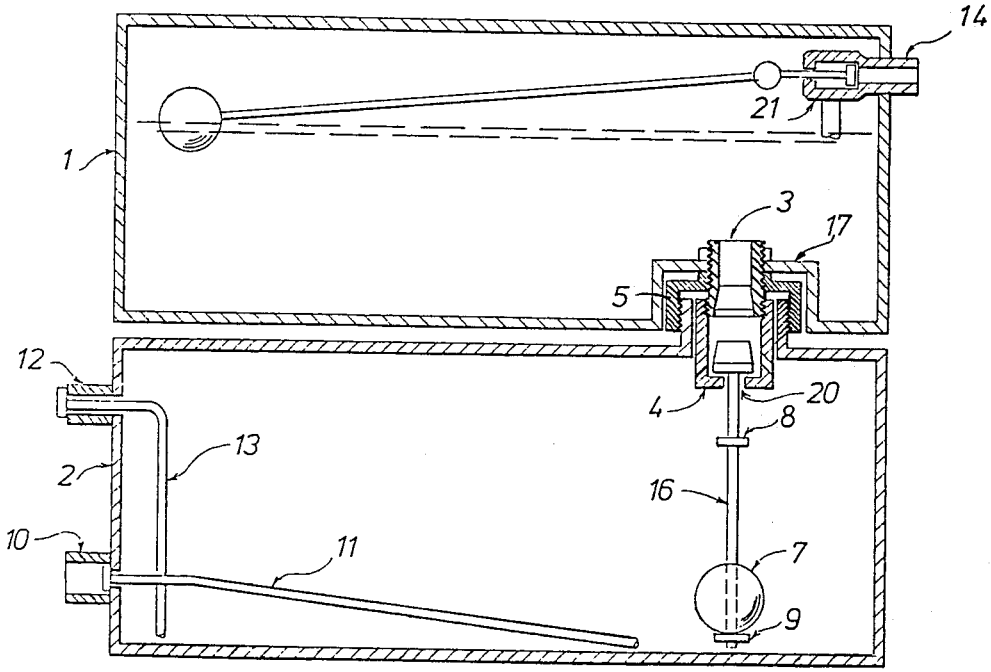
FIG. 1 is a cross-sectional view of the carbonator in accordance with the invention.

Referring now to the drawings, the carbonator shown in FIG. 1 includes an upper tank 1 with a liquid inlet port 14 and a liquid outlet cavity or conduit 3 connecting the upper tank with the lower tank 2. The upper tank 1 serves as a reservoir for storing and for cooling the liquid prior to its passage into the lower tank 2. The liquid may be cooled by placing the upper tank 1 or both tanks in a refrigerator (not shown). The liquid level in the upper tank 1 may be regulated with a commercial float valve 21 connected to the inlet port 14.

Figure 2:
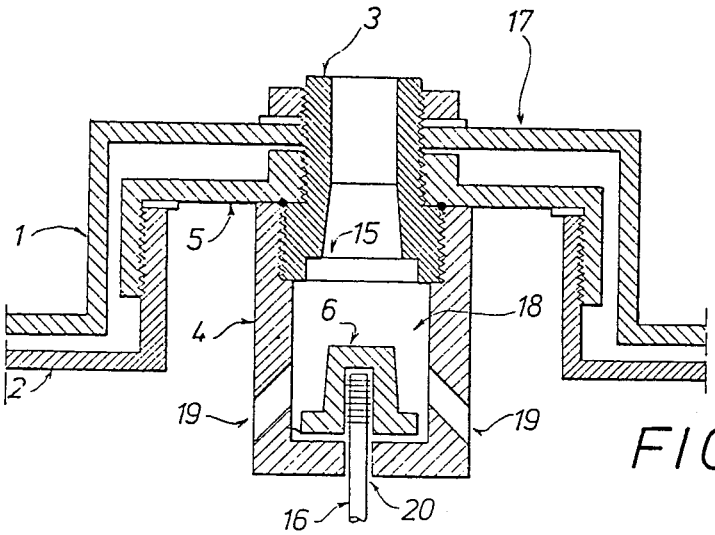
FIG. 2 is a cross-sectional detail of FIG. 1 showing the float valve connecting the two tanks of the carbonator at an enlarged scale.

The flow of the liquid from the upper tank 1 into the lower tank 2 is through a float valve connected to conduit 3. The float valve is designed to both regulate the liquid level in lower tank 2 and prevent the loss of carbon dioxide from the lower tank 2. As shown in greater detail in FIG. 2, the float valve connecting the two tanks has an upper nozzle 15 threaded through the lower plate 17 of upper tank 1 and the upper plate 5 of lower tank 2. Upper nozzle 15 is threaded together with a lower nozzle 4 which has an inner cavity 18, a plurality of orifices 19, and a duct 20. Through the duct 20 passes a float arm 16 which is connected to a float 7 situated in the lower tank 2 between an upper ring 8 and a lower ring 9. The upper end of float arm 16 is fitted in plug 6 disposed in the cavity 18 of nozzle 4.

As the liquid level in the lower tank 2 drops during use, float 7 and float arm 16 will drop and at a predetermined level plug 6 will open conduit 3, allowing the liquid from the upper tank 1 to flow through conduit 3, cavity 18 and orifices 19 into tank 2. As the liquid flows into the lower tank 2, the liquid level will rise and raise float 7 and float arm 16 until plug 6 enters conduit 3 and seals off the liquid flow from upper tank 1 and seals in the carbon dioxide in the lower tank 2. During this cycle for the filling of the lower tank 2, the float valve 21 of upper tank 1 opens and upper tank 1 is refilled with liquid.

The lower tank 2 has a gas inlet port 10 which is connected to the source of carbon dioxide (not shown). Inserted in gas inlet port 10 is a perforated pipe 11 which extends along the bottom of lower tank 2. Carbon dioxide flows through the pipe 11 and passes through the perforations carbonating the liquid in the lower tank 2.

A second liquid outlet port 12 is provided in the lower tank 2 with one end of conduit 13 attached thereto and the other end of the conduit 13 extending to a point adjacent the bottom of the lower tank 2. An external commercial valve (not shown) may be used to control the outflow of carbonated liquid from lower tank 2 through conduit 13 and outlet port 12.

As shown in FIG. 1, the float of the valve in the conduit 3 connecting the two tanks is set to open the valve and permit the liquid in the upper tank 1 to flow into the lower tank 2 when the latter is substantially empty. At that point during the operation of the apparatus, the gas pressure in the lower tank has been reduced sufficiently due to the withdrawal of the carbonated water from the tank to permit the water to flow into the lower tank from the reservoir tank by gravity. This arrangement renders the apparatus independent of the water source pressure, as well as eliminating the need for gas pressure regulating valves for adjusting the pressure of the carbon dioxide in accordance with the water supply pressure.

A signaling device activated by a float in the upper tank 1 may be provided to turn on an externally mounted light to indicate the need to recharge the lower tank with carbon dioxide when the upper tank is empty and, hence, the lower tank is full and ready to be charged with the gas. Placement of the signaling device in the upper tank simplifies the construction of the apparatus since it obviates the need for drilling mounting holes and the like in the pressurized lower tank.

I claim:

1. An apparatus for carbonating liquid such as water or other beverage comprising:

a carbonating tank having a liquid inlet port for introducing liquid to be carbonated, a liquid outlet port for dispensing carbonated liquid, and a gas inlet port for introducing pressurized carbon dioxide gas into said carbonating tank;

a reservoir tank disposed above said carbonating tank for storing the liquid to be carbonated, said reservoir tank having a liquid outlet port;

a conduit connecting said outlet port of said reservoir tank with said liquid inlet port of said carbonating tank; and valve means responsive to the level of the liquid in said carbonating tank for opening said conduit to permit liquid stored in said reservoir tank to flow into said carbonating tank under the influence of gravity until said carbonating tank becomes substantially filled, for closing said conduit thereupon, and for maintaining said conduit closed thereafter to prevent the flow of liquid from said reservoir tank into said carbonating tank until said carbonating tank is substantially empty of liquid and the pressure of the gas therein is less than the pressure of the liquid at said outlet port of said reservoir tank.

2. Apparatus according to claim 1 wherein said valve means is a float valve.

3. Apparatus according to claim 2 including a perforated pipe connected to said gas inlet port and extending along the bottom of said carbonating tank for dispersing the gas in the liquid.

4. Apparatus according to claim 3 wherein said reservoir tank has a liquid inlet port and a float valve for opening and closing said inlet port of said reservoir tank in accordance with the level of the liquid in said reservoir tank.

* * * * *